United States Patent [19]

Pahade et al.

[11] Patent Number: 5,051,120

[45] Date of Patent: Sep. 24, 1991

[54] FEED PROCESSING FOR NITROGEN REJECTION UNIT

[75] Inventors: Ravindra F. Pahade, Getzville; James J. Maloney, Tonawanda, both of N.Y.

[73] Assignee: Union Carbide Industrial Gases Technology Corporation, Danbury, Conn.

[21] Appl. No.: 536,522

[22] Filed: Jun. 12, 1990

[51] Int. Cl.[5] ..... F25J 3/02

[52] U.S. Cl. ..... 62/24; 62/43

[58] Field of Search ..... 62/11, 23, 24, 43

[56] References Cited

U.S. PATENT DOCUMENTS

| | | | |
|---|---|---|---|
| 3,592,015 | 7/1971 | Streich et al. | 62/28 |
| 3,747,359 | 7/1973 | Streich | 62/24 |
| 4,217,759 | 8/1980 | Shenoy | 62/23 |
| 4,225,329 | 9/1980 | Bailey et al. | 62/23 |
| 4,311,496 | 1/1982 | Fabian | 62/17 |
| 4,338,107 | 7/1982 | Swallow | 62/24 |
| 4,352,685 | 10/1982 | Swallow | 62/28 |
| 4,415,345 | 11/1983 | Swallow | 62/28 |
| 4,451,275 | 5/1984 | Vines et al. | 62/28 |
| 4,479,871 | 10/1984 | Pahade et al. | 208/340 |
| 4,501,600 | 2/1985 | Pahade | 62/28 |
| 4,592,767 | 6/1986 | Pahade et al. | 62/31 |
| 4,664,686 | 5/1987 | Pahade et al. | 62/24 |
| 4,710,212 | 12/1987 | Hanson et al. | 62/23 |
| 4,778,498 | 10/1988 | Hanson et al. | 62/28 |
| 4,878,932 | 11/1989 | Pahade et al. | 62/24 |
| 4,936,888 | 6/1990 | DeLong | 62/43 |
| 4,948,405 | 8/1990 | Thompson | 62/43 |

*Primary Examiner*—Ronald C. Capossela

*Attorney, Agent, or Firm*—Stanley Ktorides

[57] ABSTRACT

A system comprising a stripping column and a nitrogen rejection unit wherein a significant portion of the feed to the nitrogen rejection unit is provided at an increased pressure thus reducing product compression requirements.

11 Claims, 1 Drawing Sheet

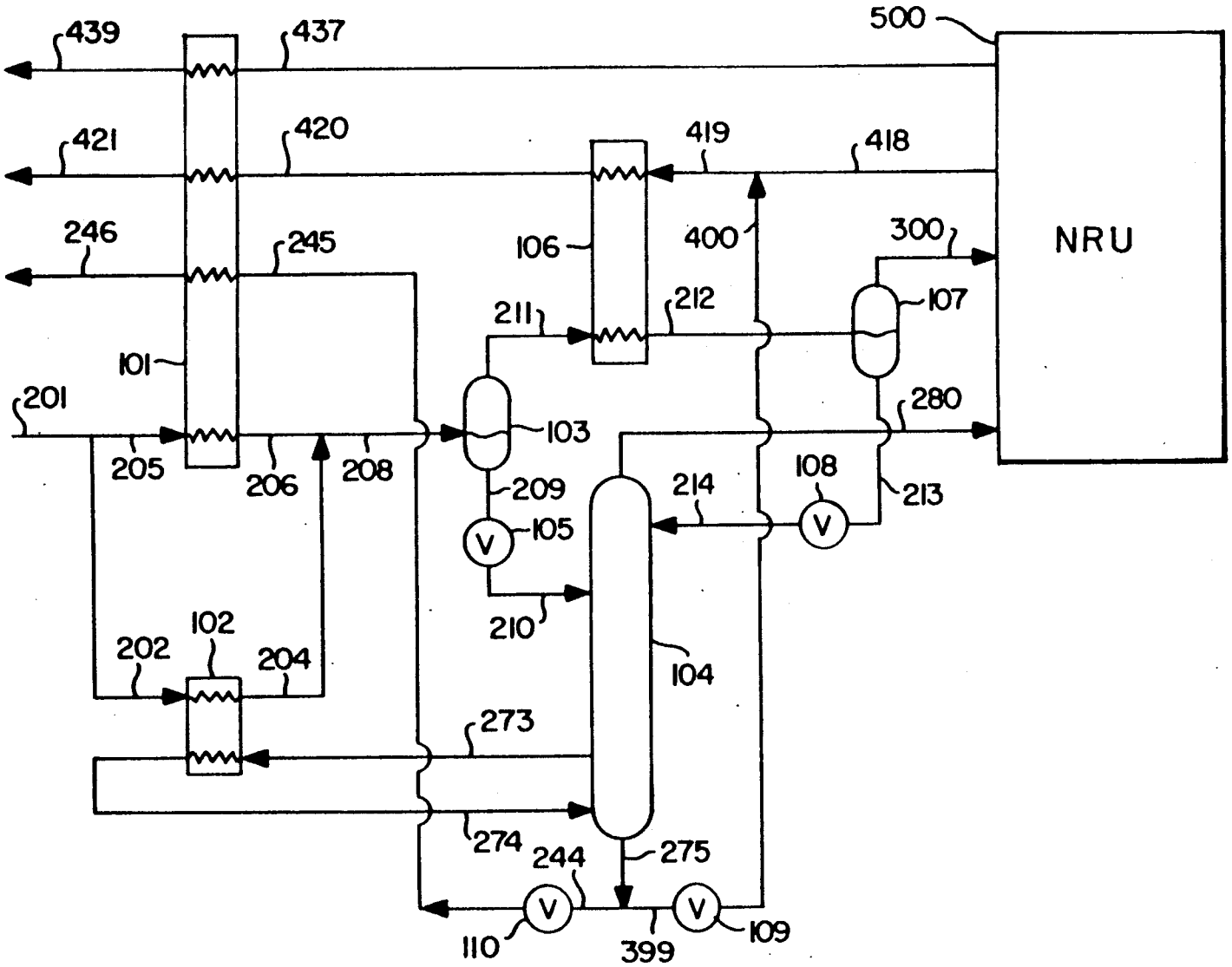
NRU
500
418
300
107
280
213
108
109
419
400
212
214
104
275
399
106
211
103
209
105
210
244
110
273
274
437
420
245
208
206
204
102
101
205
202
439
421
246
201

FEED PROCESSING FOR NITROGEN REJECTION UNIT

TECHNICAL FIELD

This invention relates generally to the separation of nitrogen and methane by cryogenic rectification and more particularly to the handling of the feed for the nitrogen-methane separation.

BACKGROUND ART

One problem often encountered in the production of natural gas from underground reservoirs is nitrogen contamination. The nitrogen may be naturally occurring and/or may have been injected into the reservoir as part of an enhanced oil recovery (EOR) or enhanced gas recovery (EGR) operation. Natural gases which contain a significant amount of nitrogen may not be saleable, since they do not meet minimum heating value specifications and/or exceed maximum inert content requirements. As a result, the feed gas will generally undergo processing, wherein heavier components such as natural gas liquids are initially removed, and then the remaining stream containing primarily nitrogen and methane, and also possibly containing lower boiling or more volatile components such as helium, hydrogen and/or neon, is separated cryogenically. A common process for separation of nitrogen from natural gas employs a double column distillation cycle, similar to that used for fractionation of air into nitrogen and oxygen.

A problem often encountered in the cryogenic separation of nitrogen and methane is the loss of some methane with the nitrogen overhead from the nitrogen rejection unit. This is especially the case where the nitrogen concentration in the feed is less than about 30 percent. In such situations there is less nitrogen available for reflux and thus the separation of the nitrogen and methane is carried out to a lesser extent than is desirable.

The problem of inadequate nitrogen reflux in a nitrogen rejection unit has been addressed by recirculating some of the nitrogen product from the separation back to the nitrogen rejection unit. Although such a system is effective in upgrading the reflux available for separation, it is disadvantageous because nitrogen which has already been separated from the nitrogen-methane mixture is returned and must be separated a second time.

A recent significant advancement in the cryogenic separation of nitrogen and methane is disclosed and claimed in U.S. Pat. No. 4,664,686-Pahade et al. In this system a stripping column is provided upstream of the nitrogen rejection unit. The stripping column serves to increase the nitrogen content of the feed to the nitrogen rejection unit thus eliminating the need for nitrogen recompression and recirculation. Another advantage of this stripping column process is that a large fraction of the methane is recoverable directly from the stripping column at an elevated pressure thereby reducing subsequent compression requirements. Still another advantage of this process is that tolerance to carbon dioxide presence in the feed is improved.

The stripping column of a nitrogen rejection system may have an optimum operating pressure lower than that of the feed. This reduces the pressure at which the nitrogen rejection unit can operate and thus reduces the potential pressure of its methane product. It would be desirable to have a nitrogen rejection unit which can produce higher pressure methane product and thus reduce product compression requirements.

Accordingly, it is an object of this invention to provide an improved stripping column/nitrogen rejection unit wherein the nitrogen rejection unit operation is at least in part decoupled from the stripping column operation so that methane product from the nitrogen rejection unit may be produced at a higher pressure than would otherwise be possible.

SUMMARY OF THE INVENTION

The above and other objects which will become apparent to one skilled in the art upon a reading of this disclosure are attained by the present invention which in general involves the processing of the feed in such a way that a significant portion of the feed can bypass the stripping column and thus be directed into the nitrogen rejection unit at the higher feed pressure.

In particular, one aspect of the invention is:

Method for cryogenic processing of a feed containing nitrogen and methane comprising:

(A) partially condensing a feed comprising nitrogen and methane to produce a first vapor and a first liquid;

(B) passing first liquid into a stripping column;

(C) partially condensing first vapor to produce a second vapor and a second liquid;

(D) passing second liquid into the stripping column; and (E) passing second vapor into a nitrogen rejection unit for separation into nitrogen-enriched and methane-enriched components.

Another aspect of the invention is:

Apparatus for cryogenic processing of a feed containing nitrogen and methane comprising:

(A) means to partially condense feed containing nitrogen and methane to produce a first vapor and a first liquid;

(B) a stripping column and means to pass first liquid into the stripping column;

(C) means to partially condense the first vapor to produce a second vapor and a second liquid;

(D) means to pass second liquid into the stripping column; and (E) a nitrogen rejection unit and means to pass second vapor into the nitrogen rejection unit.

The term "column" is used herein to mean a distillation, rectification or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column, or on packing elements, or a combination thereof. For an expanded discussion of fractionation columns see the Chemical Engineer's Handbook, Fifth Edition, edited by R. H. Perry and C. H. Chilton McGraw-Hill Book Company, New York Section 13, "Distillation" B. D. Smith et al, page 13-3, *The Continuous Distillation Process.*

The term "double column", is used herein to mean high pressure column having its upper end in heat exchange relation with the lower end of a low pressure column. An expanded discussion of double columns appears in Ruheman, "The Separation of Gases" Oxford University Press, 1949, Chapter VII, Commercial Air Separation.

The terms "nitrogen rejection unit" and "NRU" are used herein to mean a facility wherein nitrogen and methane are separated by cryogenic rectification, comprising a column and the attendant interconnecting equipment such as liquid pumps, phase separators, piping, valves and heat exchangers.

The term "indirect heat exchange" is used herein to mean the bringing of two fluid streams into heat exchange relation without any physical contact or intermixing of the fluids with each other.

As used herein the term "phase separator" means a device, such as a vessel with top and bottom outlets, used to separate a fluid mixture into its gas and liquid fractions.

The term "stripping column" is used herein to mean a column where feed is introduced into the upper portion of the column and more volatile components are removed or stripped from descending liquid by rising vapor.

As used herein the term "structured packing" means packing wherein individual members have specific orientation relative to each other and to the column axis.

BRIEF DESCRIPTION OF THE DRAWING

The sole FIGURE is a schematic flow diagram of one preferred embodiment of the improved NRU feed processing system of this invention.

DETAILED DESCRIPTION

The invention will be described in detail with reference to the Drawing.

Referring now to the FIGURE, natural gas feed 201 is partially condensed and then passed into phase separator 103. The FIGURE illustrates a preferred embodiment of the invention wherein natural gas feed 201 is divided into first portion 205 and second portion 202. The concentrations of nitrogen and methane in the feed may vary considerably; however generally the nitrogen concentration in the feed will be within the range of from 5 to 80 percent and the methane concentration in the feed will be within the range of from 20 to 95 percent. The feed may also contain some higher boiling hydrocarbons such as ethane although most of the higher boiling hydrocarbons will have been removed from the natural gas feed stream. The feed may also contain one or more lower boiling or more volatile components such as helium, hydrogen or neon. Generally the pressure of feed stream 301 will be within the range of from 500 to 1000 pounds per square inch absolute (psia), although the feed pressure may be as high as the critical pressure of the feed mixture.

Both first portion 205 and second portion 202 may be partially condensed by indirect heat exchange with at least one of the nitrogen-enriched and methane-enriched components and by liquid from stripping column 104. In the embodiment illustrated in the FIGURE, first portion 205 is partially condensed by indirect heat exchange in heat exchanger 101 against return streams, and second portion 202 is partially condensed by indirect heat exchange in heat exchanger 102 against stripping column liquid as will be more fully described later. The resulting streams 206 and 204 are combined into stream 208 and passed into phase separator 103.

Within phase separator 103 the feed is separated into first vapor having a higher nitrogen concentration, and first liquid having a higher methane concentration, than does feed 201. First liquid is passed out of separator 103 as stream 209, throttled through valve 105 and passed as stream 210 into stripping column 104 which is operating at a pressure generally within the range of from 200 to 600 psia and preferably within the range of from 300 to 550 psia.

First vapor is passed out of separator 103 as stream 211 and partially condensed by indirect heat exchange in heat exchanger 106 against return streams. Resulting two phase stream 212 is passed into phase separator 107 and separated into second vapor having a higher nitrogen concentration, and second liquid having a higher methane concentration than does the first vapor. Second liquid is passed out of separator 107 as stream 213, flashed across valve 108 and passed as stream 214 into stripping column 104. Preferably, as illustrated in the FIGURE, stream 214 is passed into stripping column 104 at a point higher than the point where stream 210 is introduced into the column.

Within stripping column 104 the feeds 210 and 214 are separated into a fraction richer in nitrogen and a fraction richer in methane by the stripping of more volatile components from descending liquid into upflowing vapor. The upflowing vapor is generated by withdrawal of liquid from column 104 as stream 273 and the vaporization of some or all of that liquid by passage through heat exchanger 102 against partially condensing feed second portion 202. Resulting stream 274 is returned to column 104. The vapor portion of stream 274 provides the upflowing vapor to carry out the stripping.

Methane-richer fraction is removed from column 104 as stream 275. The major portion 244 is flashed across valve 110, passed as stream 245 to heat exchanger 101, vaporized by passage through heat exchanger 101, and recovered as high pressure gas 246 generally having a methane concentration up to about 99 percent. The minor portion 399 is flashed across valve 109 and passed as stream 400 to and through heat exchanger 106 to cool and partially condense first vapor 211. In the preferred embodiment illustrated in the FIGURE, stream 400 is combined with methane product from the NRU to form stream 419 prior to passage through heat exchanger 106. Resulting stream 420 is passed through heat exchanger 101 and recovered as lower pressure methane gas 421. In some cases, it may be advantageous to bring out stream 400 separately at a pressure higher than stream 418 and save on methane recompression energy.

Nitrogen-richer fraction is removed from column 104 as stream 280 and passed into NRU 500 for separation into nitrogen-enriched and methane-enriched components. NRU 500 may be any system capable of separating nitrogen and methane. Generally NRU 500 comprises a double column cryogenic plant or a single column cryogenic plant.

Second vapor is removed from separator 107 and passed as stream 300 into NRU 500. Stream 300 is generally at about the same pressure as is feed 201 except for pressure drop due to line losses. In addition, the pressure of stream 300 exceeds the pressure of stream 280 which is generally at the operating pressure of stripping column 104. Stream 300 will generally be about 50 percent of the total feed into the NRU. In this way a significant portion of the feed into the NRU is at a higher pressure than would be the case with conventional NRU feed processing.

Within NRU 500 the feeds are separated into nitrogen-enriched and methane-enriched components. Methane-enriched component is removed from NRU 500 as stream 418, preferably combined with stream 400 to produce stream 419, warmed by passage through heat exchanger 106 to effect the partial condensation of first vapor 211, passed as stream 420 through heat exchanger 101 and recovered as lower pressure methane gas product 421. Nitrogen-enriched component is removed from NRU 500 as stream 437, warmed by passage through heat exchanger 101 and removed from the system as stream 439. Nitrogen-enriched component 439 may be recovered, released to the atmosphere, or injected into an oil or gas reservoir as part of a secondary recovery operation.

Because of the higher pressure at which the NRU can operate with the feed processing system of this invention, the product methane can be recovered at a higher pressure than would otherwise be the case. This reduces the product gas compression requirements which might be needed to, for example, compress methane gas to conform to pipeline requirements. Generally the system of this invention will enable a product gas compression requirement reduction of five percent or more.

Although the invention has been described in detail with reference to a certain specific embodiment, those skilled in the art will recognize that there are other embodiments of this invention within the spirit and scope of the claims.

We claim:

1. Method for cryogenic processing of a feed containing nitrogen and methane comprising:

(A) partially condensing a feed comprising nitrogen and methane to produce a first vapor and a first liquid;

(B) passing first liquid into a stripping column;

(C) partially condensing first vapor to produce a second vapor and a second liquid;

(D) passing second liquid into the stripping column;

(E) passing second vapor into a nitrogen rejection unit for separation into nitrogen-enriched and methane-enriched components;

(F) removing a stream of nitrogen-enriched component from the nitrogen rejection unit; and (G) removing a stream of methane-enriched component from the nitrogen rejection unit.

2. The method of claim 1 wherein the second liquid is passed into the stripping column at a point higher than the point where first liquid is passed into the stripping column.

3. The method of claim 1 wherein the feed is divided into first and second portions and each of the first and second portions are partially condensed by indirect heat exchange with at least one of the nitrogen-enriched component stream, the methane-enriched component stream and liquid from the stripping column.

4. The method of claim 1 wherein the fluids passed into the stripping column are separated into methane-richer and nitrogen richer fractions, at least some of the methane-richer friction is recovered as product methane, and at least some of the nitrogen-richer fraction is passed into the nitrogen rejection unit.

5. The method of claim 1 wherein the first vapor is partially condensed, at least in part, by indirect heat exchange with the methane-enriched component stream.

6. The method of claim 1 the second vapor comprises about 50 percent of the total feed into the nitrogen rejection unit.

7. Apparatus for cryogenic processing of a feed containing nitrogen and methane comprising:

(A) means to partially condense feed containing nitrogen and methane to produce a first vapor and a firs liquid;

(B) a stripping column ad means to pass first liquid into the stripping column;

(C) means to partially condense the first vapor to produce a second vapor and a second liquid;

(D) means to pass second liquid into the stripping column;

(E) a nitrogen rejection unit for producing nitrogen-enriched and methane-enriched components, and means to pass second vapor into the nitrogen rejection unit;

(F) means for removing a stream of nitrogen-enriched component from the nitrogen rejection unit; and (G) means for removing a stream of methane-enriched component from the nitrogen rejection unit.

8. The apparatus of claim 7 wherein the means to pass second liquid into the stripping column communicates with the stripping column at a point higher than the point where first liquid is passed into the stripping column.

9. The apparatus of claim 7 further comprising means to pass fluid from the stripping column to the nitrogen rejection unit.

10. The apparatus of claim 7 further comprising means to recover fluid from the stripping column.

11. The apparatus of claim 7 further comprising means to recover fluid from the nitrogen rejection unit.

* * * * *

UNITED STATES PATENT AND TRADEMARK OFFICE

CERTIFICATE OF CORRECTION

PATENT NO. : 5,051,120

DATED : September 24, 1991

INVENTOR(S) : R. F. Pahade, et al.

It is certified that error appears in the above-identified patent and that said Letters Patent is hereby corrected as shown below:

In column 2, line 59 after "mean" insert -- a --.

In claim 6, line 1 after "1" insert -- wherein --.

In claim 7, line 5 delete "firs" and insert therefor -- first --.

In claim 7, line 6 delete "ad" and insert therefor -- and --.

Signed and Sealed this

Fifth Day of January, 1993

*Attest:*

DOUGLAS B. COMER

*Attesting Officer*

*Acting Commissioner of Patents and Trademarks*